US010598042B2

(12) United States Patent
Lee

(10) Patent No.: US 10,598,042 B2
(45) Date of Patent: Mar. 24, 2020

(54) GAS TURBINE RING SEGMENT HAVING SERIALLY CONNECTED COOLING HOLES AND GAS TURBINE INCLUDING THE SAME

(71) Applicant: Doosan Heavy Industries & Construction Co., LTD., Changwon-si, Gyeongsangnam (KR)

(72) Inventor: Changyong Lee, Sejong (KR)

(73) Assignee: Doosan Heavy Industries & Construction Co., LTD., Changwon-si, Gyeongsangnam-do (KR)

( * ) Notice: Subject to any disclaimer, the term of this patent is extended or adjusted under 35 U.S.C. 154(b) by 102 days.

(21) Appl. No.: 15/889,210

(22) Filed: Feb. 6, 2018

(65) Prior Publication Data

US 2018/0223688 A1 Aug. 9, 2018

(30) Foreign Application Priority Data

Feb. 6, 2017 (KR) ..... 10-2017-0016342

(51) Int. Cl.

| | |
|---|---|
| ***F01D 25/12*** | (2006.01) |
| ***F01D 9/04*** | (2006.01) |
| ***F01D 25/24*** | (2006.01) |
| ***F01D 5/02*** | (2006.01) |
| ***F01D 25/14*** | (2006.01) |

(52) U.S. Cl.

CPC ..... *F01D 25/12* (2013.01); *F01D 9/04* (2013.01); *F01D 5/02* (2013.01); *F01D 25/14* (2013.01); *F01D 25/24* (2013.01); *F05D 2220/32* (2013.01); *F05D 2260/2212* (2013.01)

(58) Field of Classification Search

CPC ..... F01D 25/12; F01D 9/04; F01D 5/02

USPC ..... 415/173.1

See application file for complete search history.

(56) References Cited

U.S. PATENT DOCUMENTS

| | | | | |
|---|---|---|---|---|
| 5,584,651 | A * | 12/1996 | Pietraszkiewicz | F01D 11/08 415/115 |
| 8,128,344 | B2 * | 3/2012 | McGovern | F01D 11/08 415/116 |
| 8,439,634 | B1 * | 5/2013 | Liang | F01D 11/10 415/115 |
| 8,777,559 | B2 * | 7/2014 | Koyabu | F01D 11/08 415/116 |
| 9,017,012 | B2 * | 4/2015 | Brunelli | F01D 25/12 415/115 |
| 2016/0376890 | A1 * | 12/2016 | Inomata | F01D 5/08 416/96 R |
| 2017/0037730 | A1 * | 2/2017 | Tsuji | F01D 25/12 |
| 2018/0274371 | A1 * | 9/2018 | Takamura | F01D 5/186 |

* cited by examiner

*Primary Examiner* — Brian P Wolcott

(74) *Attorney, Agent, or Firm* — Foundation Law Group; Kwang Jun Kim; J D Harriman

(57) ABSTRACT

A gas turbine ring segment for a gas turbine. The gas turbine includes a rotor rotating about an axis, a housing containing the rotor to be rotatable, and a stationary wing ring disposed on an inner circumferential portion of the housing to be annular about the axis. A plurality of the gas turbine ring segments is disposed on the gas turbine to be dividable in a circumferential direction. Each of the cooling holes includes a first cooling hole and a second cooling hole having different diameters, the first cooling hole and the second cooling hole being connected serially to each other. This structure controls the flow rate of refrigerant flowing through the cooling holes while maximizing heat transfer efficiency.

17 Claims, 10 Drawing Sheets

GAS TURBINE RING SEGMENT HAVING SERIALLY CONNECTED COOLING HOLES AND GAS TURBINE INCLUDING THE SAME

CROSS REFERENCE TO RELATED APPLICATION

The present application claims priority to Korean Patent Application No. 10-2017-0016342, filed Feb. 6, 2017, the entire contents of which is incorporated herein in its entirety for all purposes by this reference.

BACKGROUND

Field

The present disclosure relates generally to a gas turbine ring segment having cooling holes in the interior thereof and a gas turbine including the same. More particularly, the present disclosure relates to a gas turbine ring segment having a structure in which cooling holes having different diameters are connected serially and a gas turbine including the same.

Description of the Related Art

Generally, as illustrated in FIG. 1, a gas turbine includes a rotor 2 rotating about an axis, a housing 3 containing the rotor 2 to be rotatable, and a stationary wing ring 11 (see FIG. 2) disposed on the inner circumferential portion of the housing 3 to be annular about the axis.

As illustrated in FIG. 2, in an axial compressor 1 disposed in the gas turbine, a housing is comprised of an upper housing 25*u* and a lower housing 25*d*, which are dividable in terms of assemblability or the like. In addition, as illustrated in FIG. 3, a stationary wing ring 11 can also be comprised of a plurality of ring segments 10, which are divided in the circumferential direction.

FIG. 4 illustrates a gas turbine ring segment 10 according to the related art. The gas turbine ring segment 10 according to the related art has cooling holes 11A and 11B having the same inner diameter.

Refrigerant flows through the cooling holes 11A and 11B to perform cooling. Here, cooling efficiency may be controlled by regulating the flow rate of refrigerant flowing through the cooling holes 11A and 11B.

However, since the inner diameter of the cooling holes 11A and 11B of the gas turbine ring segment 10 according to the related art is relatively small, the ability to increase the flow rate of refrigerant is limited.

Although attempts of increasing the inner diameter of the cooling holes to solve this problem have been proposed, the flow rate of refrigerant cannot be controlled accurately, which is problematic.

Accordingly, a technology for a gas turbine ring segment including a structure able to overcome the above-described problem of the related art is demanded.

SUMMARY OF THE DISCLOSURE

In order to achieve the above object, according to an aspect of the system, there is provided a gas turbine ring segment for a gas turbine. The gas turbine includes a rotor rotating about an axis, a housing containing the rotor to be rotatable, and a stationary wing ring disposed on an inner circumferential portion of the housing to be annular about the axis. A plurality of the gas turbine ring segments is disposed on the gas turbine to be dividable in a circumferential direction. Each of the cooling holes includes a first cooling hole and a second cooling hole having different diameters, the first cooling hole and the second cooling hole being connected serially to each other According to an embodiment of the system, a flow rate of refrigerant flowing through each of the cooling holes is controlled using the first or second cooling hole having a smaller diameter.

According to an embodiment of the system, an inner diameter of the first or second cooling hole having a greater diameter may range from 150% to 400% greater than an inner diameter of the first or second cooling hole having a smaller diameter.

According to an embodiment of the system, the first cooling hole may be located adjacently to a center of the gas turbine ring segment, and the second cooling hole may be located adjacently to an outer circumferential surface of the gas turbine ring segment to communicate with the first cooling hole In this case, a length of the first cooling hole may range from 10% to 20% of a length of the second cooling hole.

According to an embodiment of the system, a plurality of uneven structures may be provided on an inner surface of the second cooling hole.

According to an embodiment of the system, a plurality of grooves may be provided in an inner surface of the second cooling hole, extending perpendicular to a direction in which the second cooling hole extends.

According to an embodiment of the system, a plurality of threads may be provided on an inner surface of the second cooling hole.

In this case, the gas turbine ring segment may further include a first cooling hole extension having a cylindrical structure, the first cooling hole extension having threads on an outer surface to be screw-engaged with an inner surface of the second cooling hole, with a through-hole having a same inner diameter as the first cooling hole being provided in the first cooling hole extension.

According to an aspect of the system, there is provided a gas turbine including the gas turbine ring segment.

As set forth above, the gas turbine ring segment according to the system has a cooling hole structure, in which the first cooling hole and the second cooling hole having different diameters are connected serially. This structure can control the flow rate of refrigerant flowing through the cooling holes while maximizing heat transfer efficiency.

In addition, the gas turbine ring segment according to the system can control the flow rate of refrigerant flowing through the cooling holes using the smaller-diameter cooling holes among the first cooling holes and the second cooling holes, thereby improving cooling efficiency and facilitating flow rate control of refrigerant.

Furthermore, in the gas turbine ring segment according to the system, it is possible to control the flow rate of refrigerant flowing through the cooling holes by limiting the inner diameter of the first cooling holes and the inner diameter of the second cooling holes to a specific ratio, thereby improving cooling efficiency and facilitating flow rate control of refrigerant.

In addition, in the gas turbine ring segment according to the system, it is possible to significantly improve cooling efficiency by disposing the first cooling holes having a smaller diameter adjacently to the center of the gas turbine ring segment, disposing the second cooling holes adjacently to the outer circumference of the gas turbine ring segment, and forming the plurality of uneven structures on the inner surfaces of the second holes.

Furthermore, in the gas turbine ring segment according to the system, it is possible to significantly improve cooling efficiency by disposing the first cooling holes having a smaller diameter adjacently to the center of the gas turbine ring segment, disposing the second cooling holes having a larger diameter adjacently to the outer circumference of the gas turbine ring segment, and forming the plurality of grooves in or the plurality of threads on the inner surfaces of the second cooling holes.

In addition, in the gas turbine ring segment according to the system, it is possible to change the length of the first cooling holes as required by an operator by forming the plurality of threads on the inner surface of the second cooling holes and providing at least one first cooling hole extension, the outer surface of which corresponds to the threads. It is therefore possible to properly adjust refrigerant control and cooling efficiency.

The gas turbine according to the system includes the gas turbine ring segment having a specific structure. The gas turbine can control the flow rate of refrigerant flowing through the cooling holes and maximize heat transfer efficiency.

BRIEF DESCRIPTION OF THE DRAWINGS

The above and other objects, features and other advantages of the present disclosure will be more clearly understood from the following detailed description when taken in conjunction with the accompanying drawings, in which.

DETAILED DESCRIPTION

Hereinafter, exemplary embodiments of the system will be described in detail. Before that, it will be understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Throughout the specification, it will be understood that when an element is referred to as being located "on" another element, not only can it be directly formed on another element, but it can also be indirectly formed on another element via an intervening element. In addition, it will be understood that the terms "comprise", "include", "have", and any variations thereof used herein are intended to cover non-exclusive inclusions unless explicitly described to the contrary.

Figure 1:
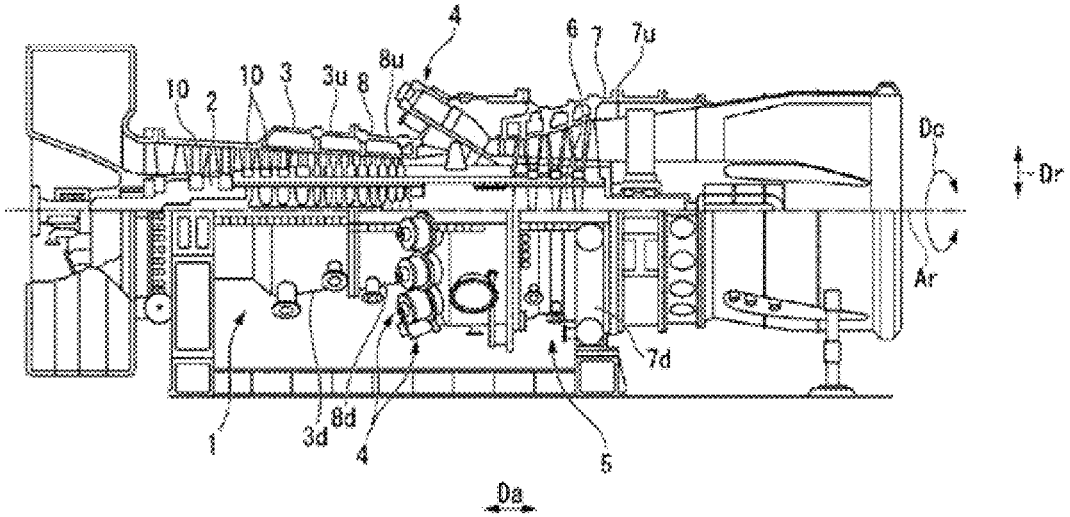
Fig. 1 Prior Art
FIG. 1 is a cross-sectional view illustrating a gas turbine according to the related art.
Figure 2:
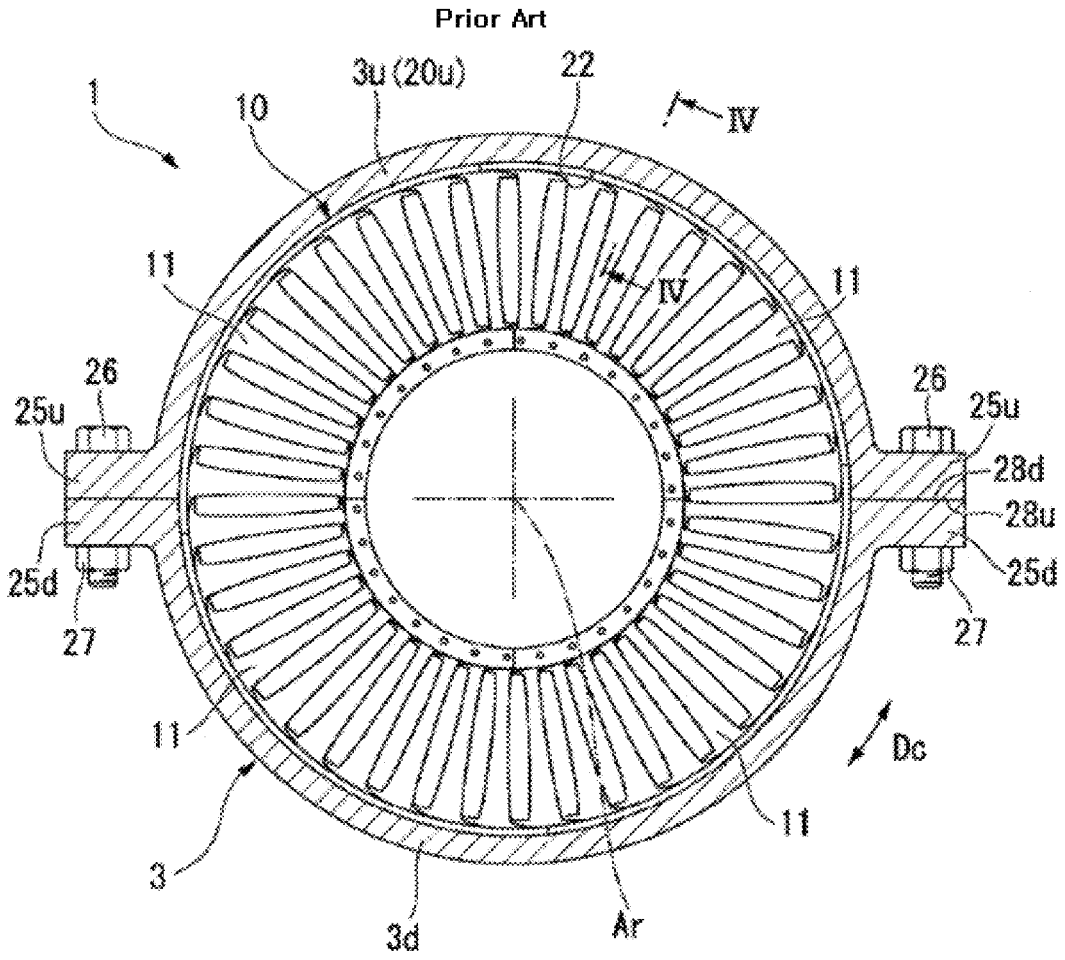
FIG. 2 is a cross-sectional view illustrating the compressor part of the gas turbine illustrated in FIG. 1.
Figure 3:
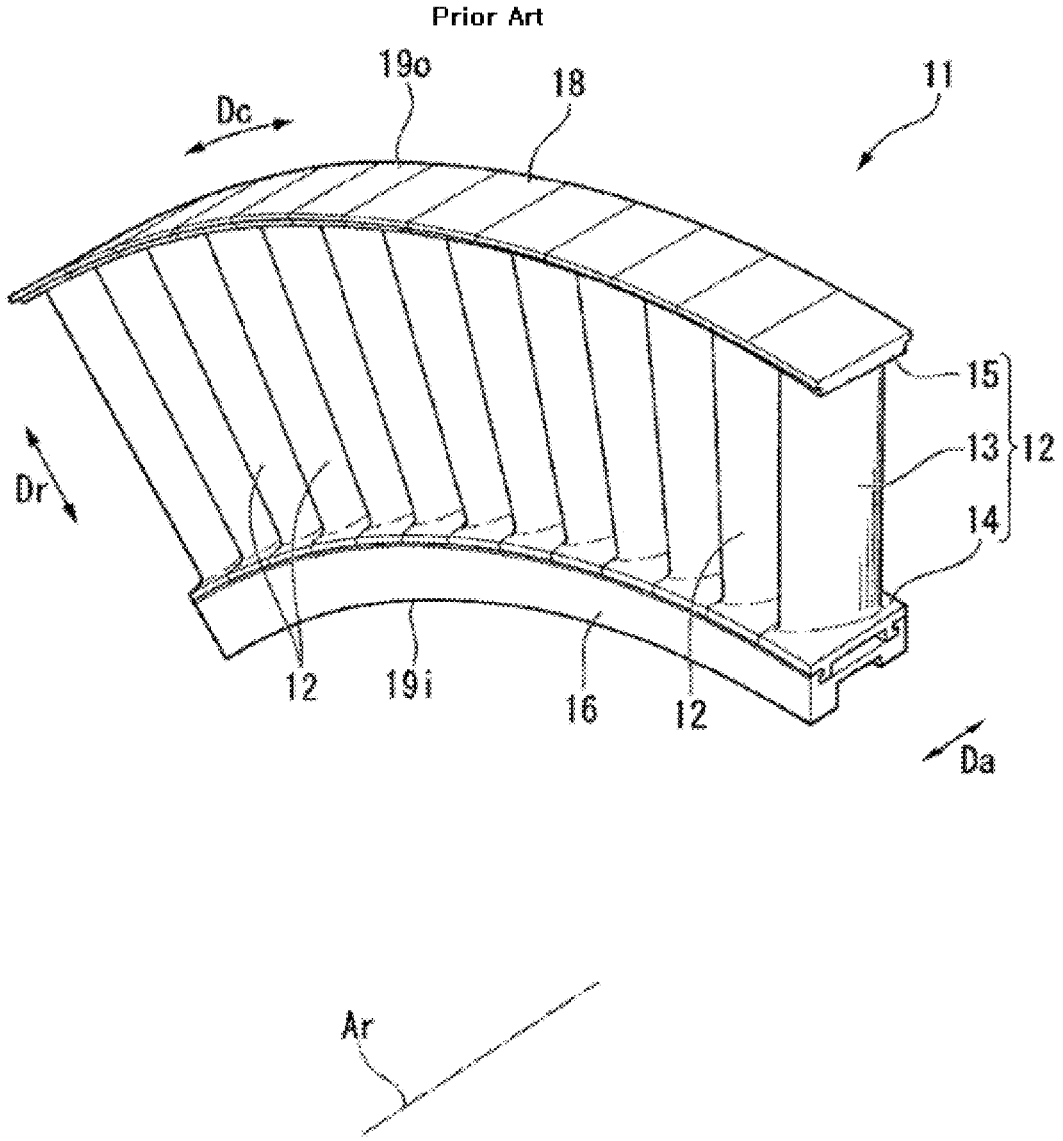
FIG. 3 is an enlarged view of the ring segment illustrated in FIG. 2.
Figure 4:
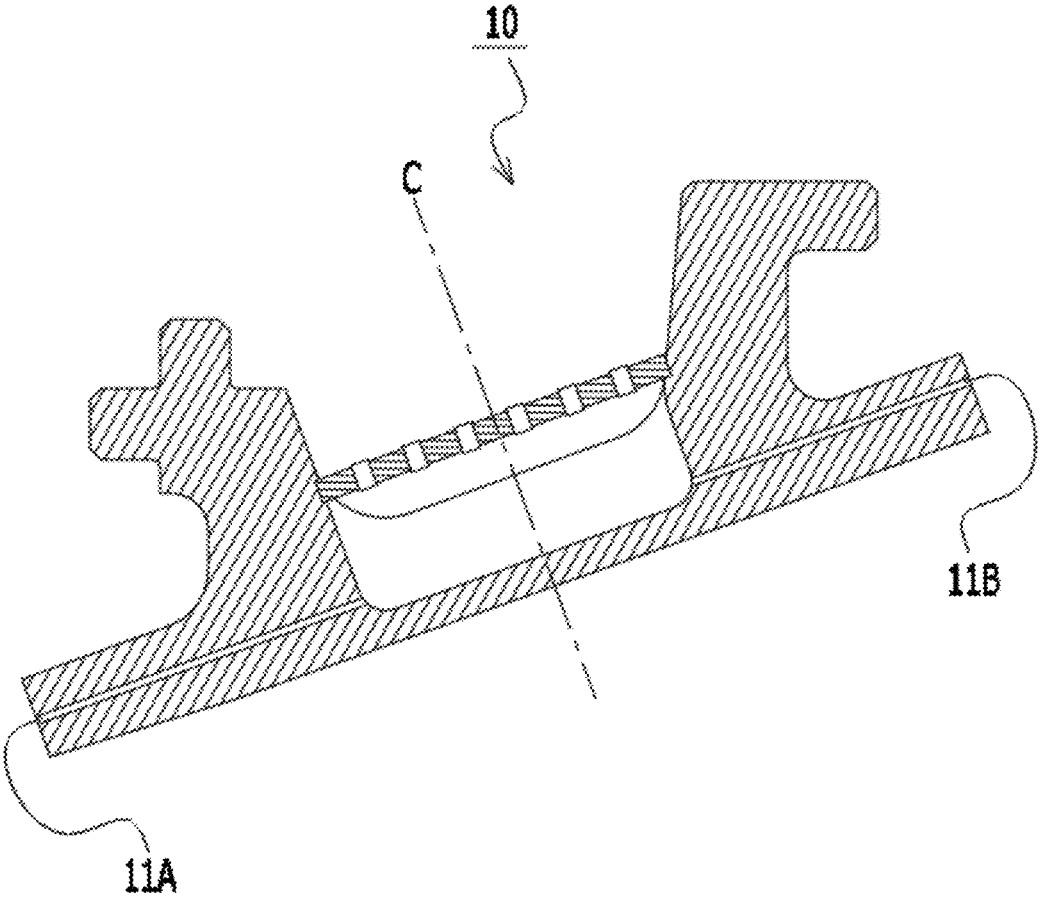
FIG. 4 is a cross-sectional view illustrating a gas turbine ring segment according to the related art.
Figure 5:
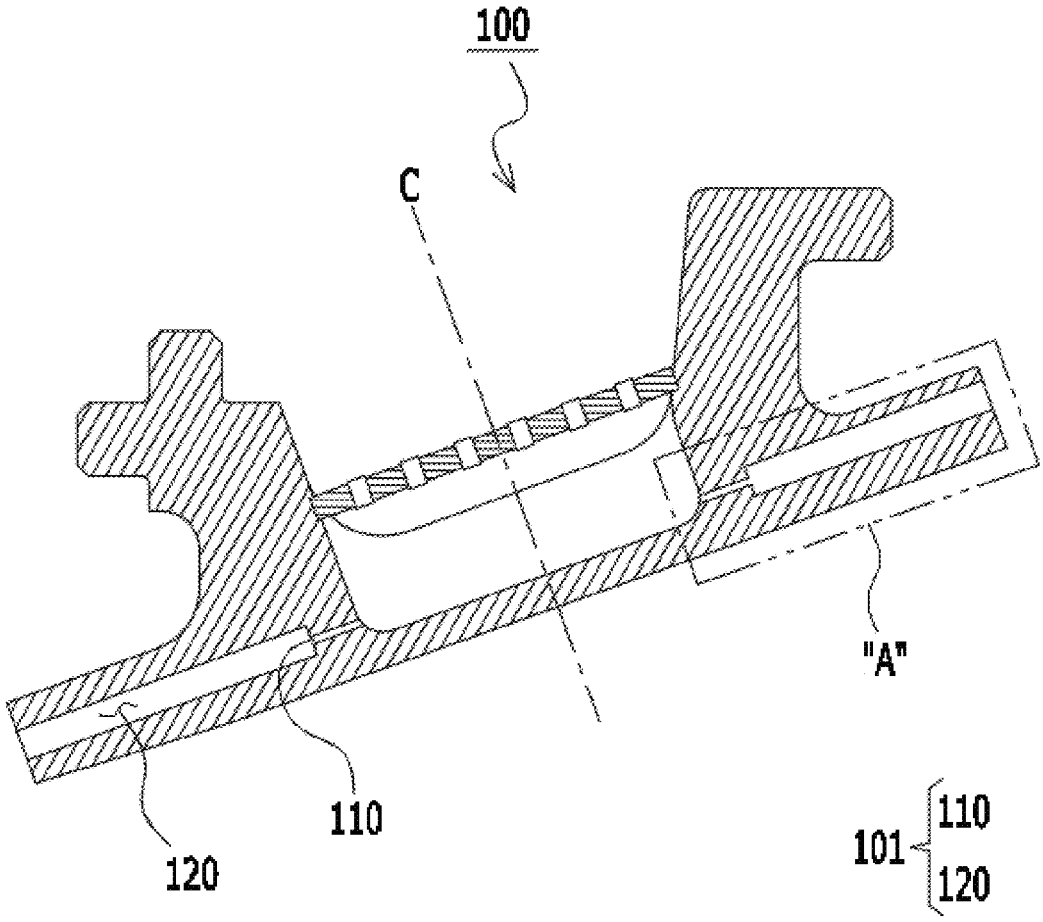
FIG. 5 is a cross-sectional view illustrating a ring segment according to an embodiment of the system.
Figure 6:
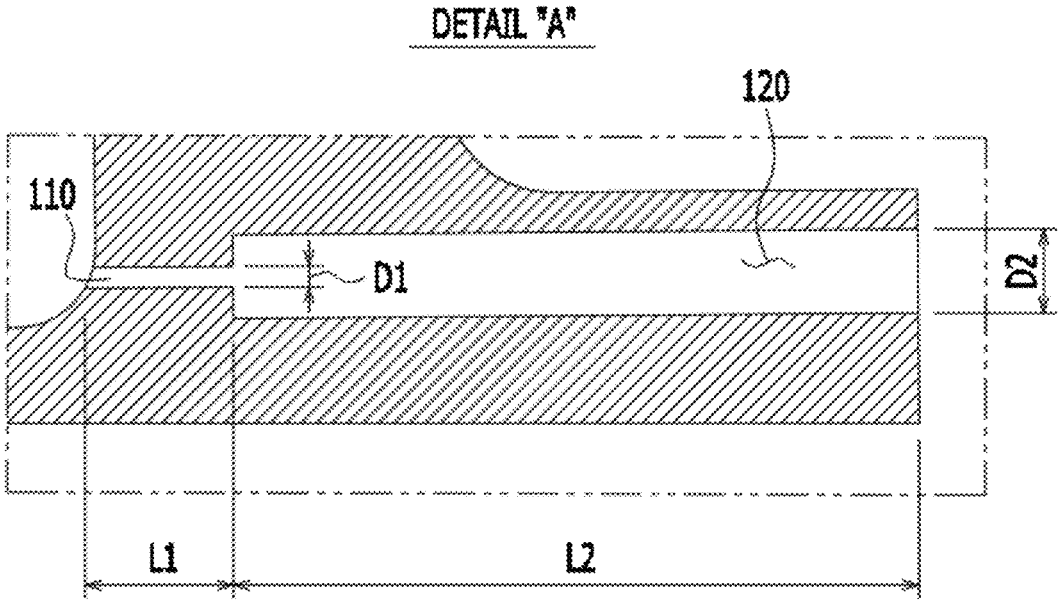
FIG. 6 is an enlarged view of part A in FIG. 5.

FIG. 5 is a cross-sectional view illustrating a ring segment according to an embodiment of the system, and FIG. 6 is an enlarged view of part A in FIG. 5.

Referring to FIGS. 5 and 6, the gas turbine ring segment 100 according to the present embodiment has cooling holes 101 arranged along the outer circumferential surface and spaced apart from each other at predetermined distances to allow the inside to communicate with the outside. Each of the cooling holes 101 includes a first cooling hole 110 and a second cooling hole 120 having different diameters.

The gas turbine ring segment 100 according to the present embodiment can control the flow rate of refrigerant flowing through the cooling holes, due to the structure in which the first and second cooling holes 110 and 120 are connected serially to each other. In addition, the gas turbine ring segment 100 has a structure able to maximize heat transfer efficiency.

Hereinafter, components of the gas turbine ring segment 100 according to the present embodiment will be described in detail with reference to the drawings.

The gas turbine ring segment 100 according to the present embodiment can control the flow rate of refrigerant flowing through the cooling holes using the cooling holes, having a smaller diameter, of the first cooling holes 110 and the second cooling holes 120.

Particularly, the cooling holes 110 having a smaller diameter may be located adjacently to the center C of the gas turbine ring segment 100, while the cooling holes 120 having a greater diameter may be located adjacently to the outer circumference of the gas turbine ring segment 100.

The gas turbine ring segment 100 according to the present embodiment can improve cooling efficiency using the cooling holes 120 having a greater diameter while controlling the flow rate of refrigerant using the cooling holes 110 having a smaller diameter.

In the first cooling holes 110 and the second cooling holes 120, the diameter of the greater-diameter cooling holes may be limited to the range of 150% to 400% greater than the diameter of the smaller-diameter cooling holes.

When the ratio of the diameter of the cooling holes is set to be less than 150%, it is not expectable to achieve significantly improved cooling efficiency using the cooling holes having a greater diameter.

In contrast, when the ratio of the diameter of the cooling holes is set to be greater than 400%, the cooling holes having a greater diameter are formed to be excessively large. This may be undesirable, since a structural defect may be caused.

In the following description, the cooling holes having a smaller diameter will be referred to as the first cooling holes 110, while the cooling holes having a greater diameter will be referred to as the second cooling holes 120.

As illustrated in FIGS. 5 and 6, the first cooling holes 110 may be located adjacently to the center C of the gas turbine ring segment 100, while the second cooling holes 120 may be located adjacently to the outer circumference of the gas turbine ring segment 100.

Here, the length L1 of the first cooling holes 110 may be limited to the range of 10% to 20% of the length L2 of the second cooling holes 120.

When the length L1 of the first cooling holes 110 is set to be less than 10% of the length L2 of the second cooling holes 120, the length L1 of the first cooling holes 110 is significantly reduced. This may be undesirable, since the flow rate of refrigerant flowing into the cooling holes 101 cannot be controlled.

When the length L1 of the first cooling holes 110 is set to be greater than 20% of the length L2 of the second cooling holes 120, the length L2 of the second cooling holes is significantly reduced. This may be undesirable, since the effect of improving cooling effect, intended to be realized in the system, may not be expectable.

Figure 7:
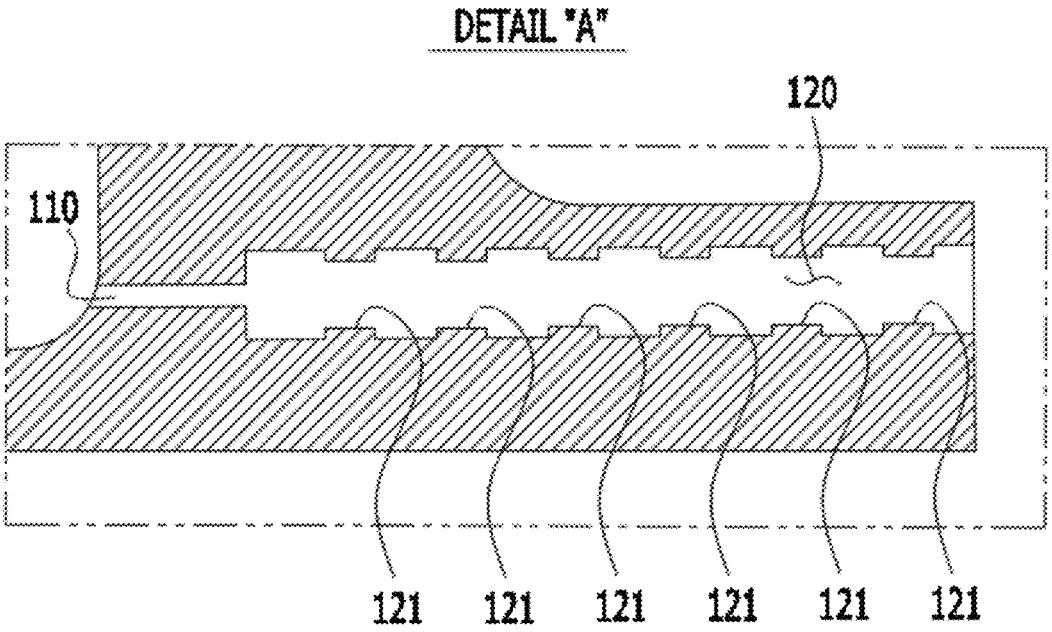
FIG. 7 is a cross-sectional view illustrating a ring segment according to another embodiment of the system.
Figure 8:
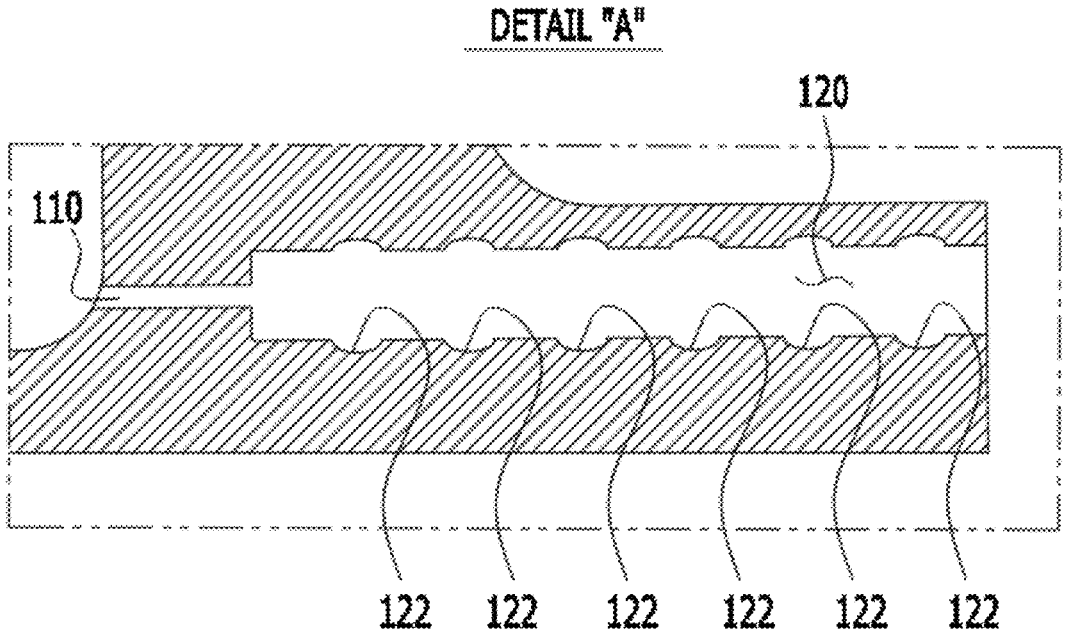
FIG. 8 is a cross-sectional view illustrating a ring segment according to a further embodiment of the system.
Figure 9:
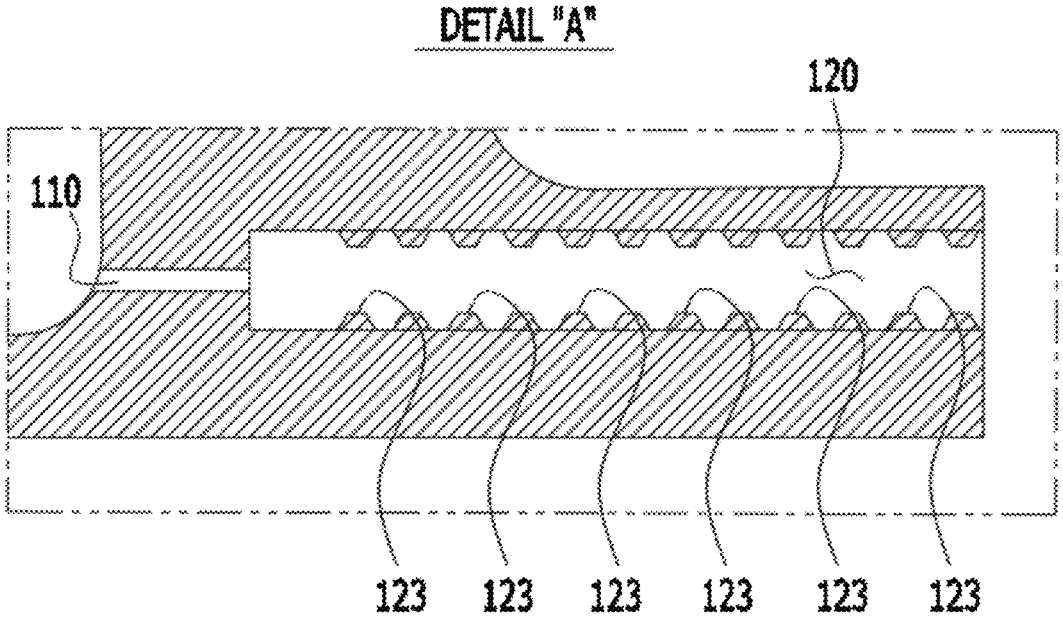
FIG. 9 is a cross-sectional view illustrating a ring segment according to another embodiment of the system.
Figure 10:
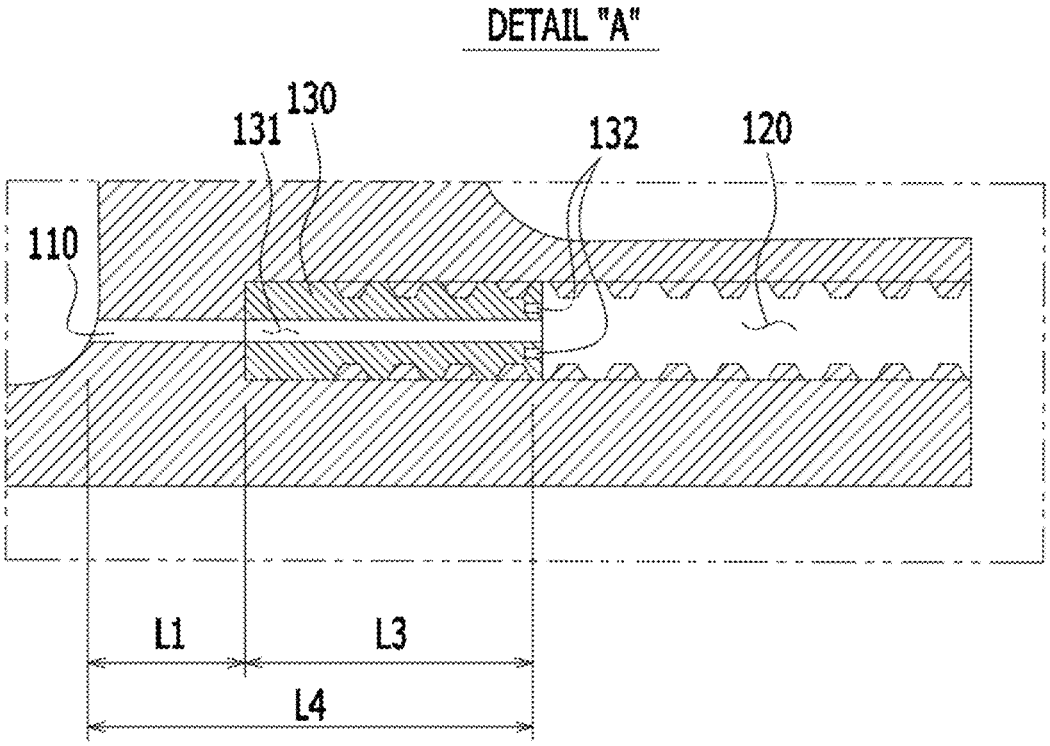
FIG. 10 is a cross-sectional view illustrating a ring segment according to a further embodiment of the system.

FIG. 7 is a cross-sectional view illustrating a ring segment according to another embodiment of the system, and FIGS. 8 to 10 are cross-sectional views illustrating ring segments according to other embodiments of the system.

Referring to FIG. 7, in the gas turbine ring segment 100 according to the present embodiment, a plurality of uneven structures may be formed on the inner surfaces of the second cooling holes 120.

In this case, refrigerant flowing through the second cooling holes 120 may come into contact with a wider surface area defined by the uneven structures 121, thereby improving cooling efficiency.

The uneven structures illustrated in FIG. 7 are an example, but the system is not limited thereto.

Referring to FIGS. 8 and 9, the uneven structures may be embodied as grooves 122 or threads 123.

As illustrated in FIG. 8, when the uneven structures are embodied as the grooves 122, the grooves 122 may extend perpendicular to the direction in which the second cooling holes 120 extend.

In this case, the grooves 122 may create a vortex in refrigerant flowing through the second cooling holes 120, thereby further improving cooling effect.

When the threads 123 are formed in the second cooling holes 120, as illustrated in FIG. 9, a first cooling hole extension 130 may be added, as illustrated in FIG. 10, to increase the length of a corresponding first cooling hole 110. For example, the length of the first cooling hole 110 may be increased to a length L4 using the first cooling hole extension 130 having a length L3, as illustrated in FIG. 9. Fastening recesses 132 are formed in one end of the first cooling hole extension 130. It is possible to move the position of the first cooling hole extension 130 by rotating the first cooling hole extension 130 using the fastening recesses 132.

Specifically, the first cooling hole extension 130 has a cylindrical structure. The first cooling hole extension 130 has threads on the outer circumferential surface thereof to be screw-engaged with the inner circumferential surface of a corresponding second cooling hole 120. The first cooling hole extension 130 has a through-hole 131 having the same inner diameter as the first cooling hole 110.

As set forth above, the gas turbine ring segment 100 according to the system has a cooling hole structure, in which the first cooling hole 110 and the second cooling hole 120 having different diameters are connected serially. This structure can control the flow rate of refrigerant flowing through the cooling holes 101 while maximizing heat transfer efficiency.

In addition, the gas turbine ring segment 100 according to the system can control the flow rate of refrigerant flowing through the cooling holes 101 using the smaller-diameter cooling holes among the first cooling holes 110 and the second cooling holes 120, thereby improving cooling efficiency and facilitating flow rate control of refrigerant.

Furthermore, in the gas turbine ring segment 100 according to the system, it is possible to control the flow rate of refrigerant flowing through the cooling holes 101 by limiting the inner diameter of the first cooling holes 110 and the inner diameter of the second cooling holes 120 to a specific ratio, thereby improving cooling efficiency and facilitating flow rate control of refrigerant.

In addition, in the gas turbine ring segment 100 according to the system, it is possible to significantly improve cooling efficiency by disposing the first cooling holes 110 having a smaller diameter adjacently to the center of the gas turbine ring segment, disposing the second cooling holes 120 adjacently to the outer circumference of the gas turbine ring segment, and forming the plurality of uneven structures 121 on the inner surfaces of the second holes 120.

Furthermore, in the gas turbine ring segment 100 according to the system, it is possible to significantly improve cooling efficiency by disposing the first cooling holes 110 having a smaller diameter adjacently to the center of the gas turbine ring segment, disposing the second cooling holes 120 adjacently to the outer circumference of the gas turbine ring segment, and forming the plurality of grooves 122 in or the plurality of threads 123 on the inner surfaces of the second cooling holes 120.

In addition, in the gas turbine ring segment 100 according to the system, it is possible to change the length of the first cooling holes 110 as required by an operator by forming the plurality of threads 123 on the inner surface of the second cooling holes 120 and providing at least one first cooling hole extension 130, the outer surface of which corresponds to the threads. It is therefore possible to properly adjust refrigerant control and cooling efficiency.

According to an embodiment of the system, also provided is a gas turbine including the gas turbine ring segment 100. According to the present embodiment, the gas turbine can control the flow rate of refrigerant flowing through the cooling holes 101 and maximize heat transfer efficiency, since the gas turbine is provided with the gas turbine ring segment 100 having a specific structure.

In the foregoing detailed description, the system has been described with respect to the specific embodiments thereof. It should be understood, however, that the system is by no means limited to the above-stated specific forms but shall include all variations, equivalents, and substitutes falling within the spirit and scope of the system defined by the appended Claims.

It should be understood that the system should not be limited to the foregoing specific embodiments or description. Rather, a variety of modifications are possible to a person skilled in the art without departing from the concept of the system and such modifications fall within the scope of the system.

What is claimed is:

1. A gas turbine ring segment for a gas turbine comprising a rotor rotating about an axis, a housing containing the rotor to be rotatable, and a stationary wing ring disposed on an inner circumferential portion of the housing to be annular about the axis, a plurality of the gas turbine ring segments being disposed on the gas turbine to be dividable in a circumferential direction, the gas turbine ring segment comprising a cooling hole structure comprised of cooling holes arranged along an outer circumferential surface and spaced apart from each other at predetermined distances to allow an inside to communicate with an outside, wherein each of the cooling holes comprises a first cooling hole and a second cooling hole having different diameters, the first cooling hole and the second cooling hole being connected serially to each other and having a straight structure from outside the gas turbine ring to the inside, wherein the first cooling hole is located adjacently to a center of the gas turbine ring segment, and the second cooling hole is located adjacently to an outer circumferential surface of the gas turbine ring segment to communicate with the first cooling hole, wherein a length of the first cooling hole ranges from 10% to 20% of a length of the second cooling hole, and wherein a flow rate of refrigerant flowing through each of the cooling holes is controlled using the first or second cooling hole having a smaller diameter.

2. The gas turbine ring segment according to claim 1, wherein an inner diameter of the first or second cooling hole having a greater diameter ranges from 150% to 400% greater than an inner diameter of the first or second cooling hole having a smaller diameter.

3. The gas turbine ring segment according to claim 1, wherein a plurality of uneven structures is provided on an inner surface of the second cooling hole.

4. The gas turbine ring segment according to claim 1, wherein a plurality of grooves is provided in an inner surface of the second cooling hole, extending perpendicular to a direction in which the second cooling hole extends.

5. The gas turbine ring segment according to claim 1, wherein a plurality of threads is provided on an inner surface of the second cooling hole.

6. The gas turbine ring segment according to claim 5, further comprising a first cooling hole extension having a cylindrical structure, the first cooling hole extension having threads on an outer surface to be screw-engaged with an inner surface of the second cooling hole, with a through-hole having a same inner diameter as the first cooling hole being provided in the first cooling hole extension.

7. A gas turbine comprising the gas turbine ring segment as claimed in claim 1.

8. A gas turbine ring segment for a gas turbine comprising a rotor rotating about an axis, a housing containing the rotor to be rotatable, and a stationary wing ring disposed on an inner circumferential portion of the housing to be annular about the axis, a plurality of the gas turbine ring segments being disposed on the gas turbine to be dividable in a circumferential direction, the gas turbine ring segment comprising a cooling hole structure comprised of cooling holes arranged along an outer circumferential surface and spaced apart from each other at predetermined distances to allow an inside to communicate with an outside, wherein each of the cooling holes comprises a first cooling hole and a second cooling hole having different diameters, the first cooling hole and the second cooling hole being connected serially to each other and having a straight structure from outside the gas turbine ring to the inside, wherein a flow rate of refrigerant flowing through each of the cooling holes is controlled using the first or second cooling hole having a smaller diameter, wherein the first cooling hole is located adjacently to a center of the gas turbine ring segment, and the second cooling hole is located adjacently to an outer circumferential surface of the gas turbine ring segment to communicate with the first cooling hole, and wherein a length of the first cooling hole ranges from 10% to 20% of a length of the second cooling hole.

9. The gas turbine ring segment according to claim 8, wherein an inner diameter of the first or second cooling hole having a greater diameter ranges from 150% to 400% greater than an inner diameter of the first or second cooling hole having a smaller diameter.

10. The gas turbine ring segment according to claim 8, wherein a plurality of uneven structures is provided on an inner surface of the second cooling hole.

11. The gas turbine ring segment according to claim 8, wherein a plurality of grooves is provided in an inner surface of the second cooling hole, extending perpendicular to a direction in which the second cooling hole extends.

12. The gas turbine ring segment according to claim 8, wherein a plurality of threads is provided on an inner surface of the second cooling hole.

13. The gas turbine ring segment according to claim 12, further comprising a first cooling hole extension having a cylindrical structure, the first cooling hole extension having threads on an outer surface to be screw-engaged with an inner surface of the second cooling hole, with a through-hole having a same inner diameter as the first cooling hole being provided in the first cooling hole extension.

14. A gas turbine ring segment for a gas turbine comprising a rotor rotating about an axis, a housing containing the rotor to be rotatable, and a stationary wing ring disposed on an inner circumferential portion of the housing to be annular about the axis, a plurality of the gas turbine ring segments being disposed on the gas turbine to be dividable in a circumferential direction, the gas turbine ring segment comprising a cooling hole structure comprised of cooling holes arranged along an outer circumferential surface and spaced apart from each other at predetermined distances to allow an inside to communicate with an outside, wherein each of the cooling holes comprises a first cooling hole and a second cooling hole having different diameters, the first cooling hole and the second cooling hole being connected serially to each other and having a straight structure from outside the gas turbine ring to the inside, wherein a flow rate of refrigerant flowing through each of the cooling holes is controlled using the first or second cooling hole having a smaller diameter, wherein a length of the first or second cooling hole having a shorter length ranges from 10% to 20% of a length of the first or second cooling hole having a greater length, wherein an inner diameter of the first or second cooling hole having a greater diameter ranges from 150% to 400% greater than an inner diameter of the first or second cooling hole having a smaller diameter, and wherein the first cooling hole is located adjacently to a center of the gas turbine ring segment, and the second cooling hole is located adjacently to an outer circumferential surface of the gas turbine ring segment to communicate with the first cooling hole.

15. The gas turbine ring segment according to claim 14, wherein a plurality of uneven structures is provided on an inner surface of the second cooling hole.

16. The gas turbine ring segment according to claim 14, wherein a plurality of grooves is provided in an inner surface of the second cooling hole, extending perpendicular to a direction in which the second cooling hole extends.

17. A gas turbine ring segment for a gas turbine comprising a rotor rotating about an axis, a housing containing the rotor to be rotatable, and a stationary wing ring disposed on an inner circumferential portion of the housing to be annular about the axis, a plurality of the gas turbine ring segments being disposed on the gas turbine to be dividable in a circumferential direction, the gas turbine ring segment comprising a cooling hole structure comprised of cooling holes arranged along an outer circumferential surface and spaced apart from each other at predetermined distances to allow an inside to communicate with an outside, wherein each of the cooling holes comprises a first cooling hole and a second cooling hole having different diameters, the first cooling hole and the second cooling hole being connected serially to each other, wherein a flow rate of refrigerant flowing through each of the cooling holes is controlled using the first or second cooling hole having a smaller diameter, and wherein a plurality of threads is provided on an inner surface of the second cooling hole, the gas turbine ring segment further comprising a first cooling hole extension having a cylindrical structure, the first cooling hole extension having threads on an outer surface to be screw-engaged with an inner surface of the second cooling hole, with a through-hole having a same inner diameter as the first cooling hole being provided in the first cooling hole extension.

* * * * *